United States Patent [19]

Gibbs

[11] Patent Number: 4,803,769

[45] Date of Patent: Feb. 14, 1989

[54] LUGGAGE CORNER CONSTRUCTION METHOD

[76] Inventor: Richard B. Gibbs, 11548 Thurston Cir., Los Angeles, Calif. 90049

[21] Appl. No.: 109,867

[22] Filed: Oct. 19, 1987

Related U.S. Application Data

[62] Division of Ser. No. 948,009, Dec. 31, 1986, abandoned.

[51] Int. Cl.[4] ..... A45C 13/36

[52] U.S. Cl. ..... 29/416; 190/124

[58] Field of Search ..... 29/400 M, 401.1, 415, 29/416; 190/124, 125, 126, 127

[56] References Cited

U.S. PATENT DOCUMENTS

| | | | |
|---|---|---|---|
| 1,433,263 | 10/1922 | Dresner | 190/127 X |
| 1,592,826 | 7/1926 | Godfrey . | |
| 2,903,105 | 9/1959 | Harvey | 190/124 |
| 3,763,973 | 10/1973 | Taylor . | |
| 4,287,971 | 9/1981 | Doulet . | |

FOREIGN PATENT DOCUMENTS

| | | |
|---|---|---|
| 163246 | 6/1953 | Australia . |
| 1164440 | 5/1958 | France . |
| 376764 | 11/1939 | Italy . |

*Primary Examiner*—P. W. Echols
*Assistant Examiner*—Joseph M. Gorski
*Attorney, Agent, or Firm*—Kelly, Bauersfeld & Lowry

[57] ABSTRACT

An item of luggage includes a rigid, generally rectangular luggage body having rounded corners, and a pair of generally rectangular, flexible walls which engage opposite sides of the luggage body to define the luggage interior. The corners of the flexible walls are cut to form notches, and a section of flexible, resilient material is sewn into the notches in a manner causing the section of material to form a three-dimensional, contoured shape having an edge which can be placed against and sewn to an adjacent rounded edge of the luggage body. PVC piping is sewn between the flexible walls and the luggage body and section of flexible, resilient material to give the luggage a pleasing appearance and to help strengthen the corner construction.

17 Claims, 1 Drawing Sheet

LUGGAGE CORNER CONSTRUCTION METHOD

This is a division of application Ser. No. 948,009, filed Dec. 31, 1986, now abandoned.

BACKGROUND OF THE INVENTION

This invention relates generally to luggage and methods of making same, and, more specifically, to a type of corner construction which has the effect of strengthening the luggage corners without employing rigid, inflexible materials.

There are many different types of luggage on the market today ranging from soft and very flexible bags to rigid containers. The broad range of luggage items available reflects the varying needs of the public. Soft luggage is viewed as providing a lightweight alternative to the more traditional rigid luggage pieces, and it can also in many instances be stored in a folded or collapsed manner. The primary drawback of such soft luggage, however, is that it offers a minimal level of protection for contents. More rigid luggage, whether constructed of woods, metals or plastics, offers far more protection for contents placed therein, although it tends to be somewhat more bulky and less easy to carry.

In an effort to accomodate the wide variety of customer preferences, luggage manufacturers and suppliers have offered several semi-rigid items of luggage which give greater content protection than the soft fabric luggage, but are far more flexible than the more traditional rigid luggage. More particularly, several semi-rigid items of luggage are presently on the market which comprise a rigid luggage body forming a protective frame, and flexible walls attached to the luggage body. This luggage body is typically a unitary, generally rectangular piece which may be covered with leather, vinyl or some other type of fabric, and it typically defines the depth of the luggage item. The flexible walls, which may include one or more pockets, are usually sewn or otherwise attached to the luggage body to form the front and back of the luggage item. To gain access to the interior of such items of luggage, a zipper is often provided, either on one of the walls or between two portions of the luggage body itself.

Because some have objected to the appearance of flat-walled semi-rigid luggage items, designers have sought ways to create a more contoured appearance while still utilizing flexible materials for the walls. The use of flexible materials for the walls has in the past, however, precluded designers from having the opportunity to create a truly three-dimensional rounded "look" for the corners of the semi-rigid luggage. More specifically, although the corners of the generally rectangular luggage body have been rounded to enhance the luggage appearance, the flexible wall materials adjacent those rounded corners have not been formed into a three-dimensional arch-shape without use of rigid, inflexible materials.

Accordingly, there has been a need for a unique luggage corner construction and related method which will permit soft, flexible materials to be sewn to a luggage body in a manner creating an aesthetically pleasing three-dimensional shape. It would be preferable that such corner construction add strength and resiliency to the corners of the luggage item, which typically are subjected to the greatest abuse during normal use. Further, a unique luggage corner construction for semi-rigid luggage items is needed which is economical to implement, utilizes a minimal amount of material, and can be adapted for various styles of luggage. The present invention fulfills these needs and provides other related advantages.

SUMMARY OF THE INVENTION

The present invention resides in a novel luggage corner construction which can be quickly and easily made, and which strengthens the luggage item while giving it a pleasing appearance. The unique luggage corner construction is typically placed adjacent a rounded edge of a rigid, generally rectangular luggage body, and can be constructed of the same flexible and resilient material forming the front and back luggage walls. When properly formed, the corner construction of the present invention provides the luggage wall corners a three-dimensional, arch-shape having an edge that can be placed adjacent and sewn to the luggage body.

In a preferred form of the invention, curved notches are cut from the corners of a generally rectangular sheet of flexible and resilient material properly sized for use with a particular luggage body. The material cut from the rectangular sheet (the notch remnant) is trimmed, and then its peripheral portion is folded downwardly to create a peripheral notch remnant flange. Similarly, the edge of each wall notch is folded downwardly to create a wall notch flange.

A section of flexible piping is situated adjacent the curved wall notch between the wall notch flange and the notch remnant flange. This flexible piping includes a relatively flat flange portion and a relatively cylindrical or rounded portion which is positioned to extend exteriorly. The wall notch flange, the piping flange portion and the remnant flange are sewn together in a manner forming the notch remnant into a three-dimensional arch-shape. When this has been done, the peripheral edges of the wall and the unattached portion of the notch remnant may be sewn to the luggage body.

The generally rectangular, flexible and resilient wall is preferably constructed to include a pressed polyethylene interior having a laminated, tear and water resistant exterior. The section of flexible piping is preferably constructed of a PVC material. This piping can also be placed between the luggage body, on the one hand, and the flexible and resilient wall and notch remnant, on the other. When constructed as shown in the accompanying drawings, the strength of the luggage corner is enhanced while also forming a pleasing contoured appearance. Further, the three-dimensional arch-shape of the notch remnant tends to give the peripheral portions of the wall a transition curvature between the primary plane of the wall and the planes of adjacent portions of the luggage body.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
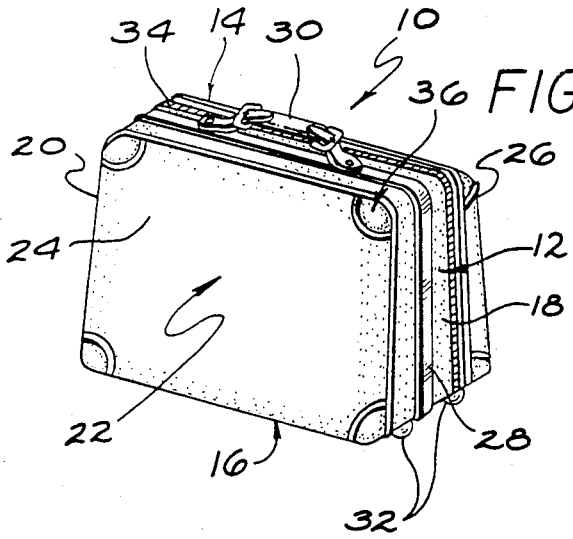
FIG. 1 is a perspective view of a semi-rigid item of luggage constructed in accordance with the present invention.

As shown in the drawings for purposes of illustration, the present invention is concerned with a novel form of corner construction for an item of luggage, generally designated in the accompanying drawings by the reference number 10. The luggage 10 includes a rigid, generally rectangular luggage body 12 forming the top 14, bottom 16 and sides 18 and 20 of the luggage item 10, and a pair of generally rectangular, flexible and resilient walls 22 forming the front 24 and back 26 of the luggage item.

A leather strip 28 is sewn to the top and sides of the luggage body 12 primarily for aesthetic purposes, and a handle 30 is attached to the top of the luggage body over the leather strip. Small wheels or rollers 32 are affixed to the bottom of the luggage body 12. Further, a zipper 34 is provided to permit access to the interior of the luggage 10. The zipper 34 separates the primary structure of the luggage body 12 from a generally rectangular, rigid rib (not shown), which provides the support for the back wall 22. For purposes of this description of the invention, the rib and the luggage body 12 have identical functions.

In accordance with the present invention, and as illustrated best in FIGS. 2-5, a novel three dimensional, arch-shaped corner 36 is created by initially sizing a sheet 38 of pressed polyethylene 40 having a laminated, tear and water resistant exterior 42, to be slightly greater than the height and width of the luggage body 12. Each corner of this sheet 38 is cut to form a curved notch 44, and the notch remnant 46 created by the cut is further trimmed to remove its linear edges. The portion 48 is trimmed from the notch remnant 46 is illustrated by dashed lines in FIG. 5.

The portions of the sheet 38 adjacent the curved notch 44 are folded downwardly (toward the layer of pressed polyethylene 40) to create a downwardly extending wall notch flange 50. Similarly, the periphery of the notch remnant 46 is folded downwardly to create a remnant flange 52.

A section of a flexible piping 54 is positioned adjacent the wall notch flange 50. This flexible piping 54 is preferably constructed of a polyvinylchloride (PVC) material, and includes a relatively flat piping flange 56 and a relatively cylindrical or rounded portion 58. When the flexible piping 54 is placed within the curved notch 44, the piping flange 56 is situated immediately adjacent the wall notch flange 50. The notch remnant 46 is then positioned to place the remnant flange 52 adjacent the piping flange 56 opposite the wall notch flange 50, and then all three of these flanges are connected to one another by stitching 60 or the like. In such an assembly, the rounded portion 58 of the flexible piping 54 is permitted to extend exteriorly.

Figure 4:
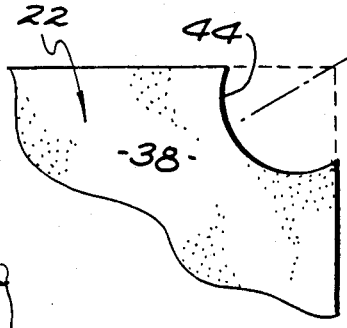
FIG. 4 is an enlarged sectional view taken generally along the line 4—4 of FIGS. 2 and 3, illustrating the manner in which various portions of the luggage item are "tucked" and sewn together to create the unique, three-dimensional corner shape.
Figure 4:
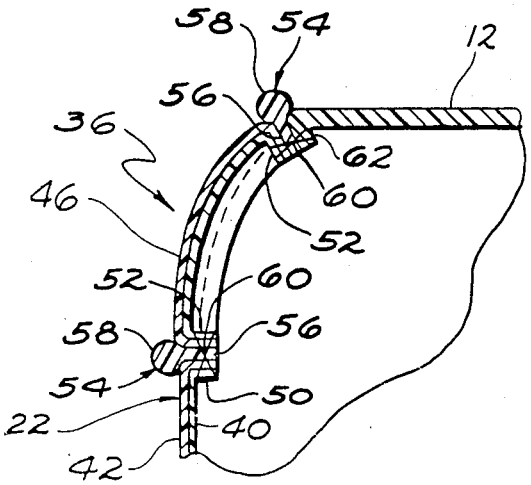

When constructed as described above, the corners 36 of the walls 22 form a three dimensional arch-shape. When all four corners of a wall 22 have been so constructed, then the wall can be attached, by stitching or the like, to the luggage body 12. In attaching the wall 22 (including the notch remnant 46) to the luggage body 12, the periphery of the wall 22 is folded downwardly to create a connecting flange (not shown) in the same manner described above in connection with the wall notch flange 50. Material forming the luggage body 12 is likewise folded downwardly to create a body flange 62, and additional flexible piping 54 is placed adjacent the luggage body flange (FIG. 4). If necessary, some of the exposed edge of the notch remnant 46 may be trimmed to conform with the rounded corner of the luggage body 12.

Figure 2:
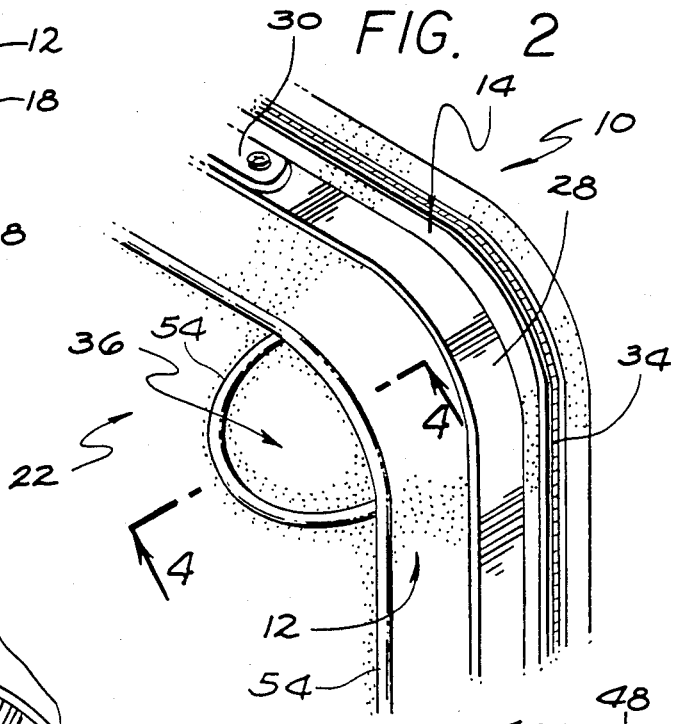
FIG. 2 is an enlarged perspective view of a corner of the luggage item illustrated in FIG. 1.
Figure 3:
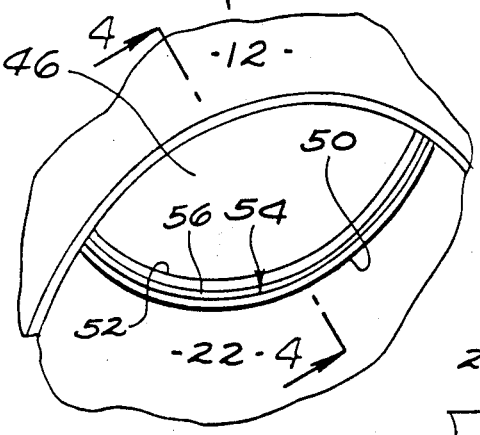
FIG. 3 is an interior view of the corner construction of the present invention, showing the inside surfaces of the corner exteriorly illustrated in FIG. 2.
Figure 5:
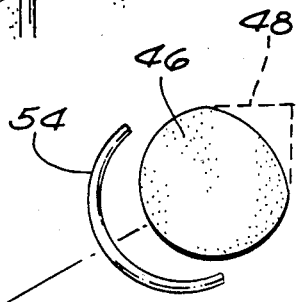
FIG. 5 is a fragmented, exploded view of a flexible luggage wall, illustrating the manner in which a notch is cut from the wall to create a notch remnant, the manner in which the notch remnant is typically trimmed, and how a section of flexible piping is usually interposed between the notch remnant and the wall notch prior to reassembly.

The wall 22 will tend to form a transitional curve between the primary plane of the wall and the adjacent plane of the luggage body 12 when attached to the luggage body as illustrated in FIG. 2. This enhances the aesthetic appearance of the item of luggage 10, and also ends to increase the strength of those portions of the wall 22 adjacent the luggage body 12.

From the foregoing it is to be appreciated that the unique corner construction of the present invention gives the item of luggage 10 a shape not otherwise possible without use of rigid materials. Moreover, the particular corner construction illustrated, in conjunction with the flexible yet resilient materials utilized for the walls 22, adds strength and resiliency to a portion of the luggage subject to abuse during normal use. Additionally, it should be apparent that the described corner construction could be effected on the back of the illustrated luggage 10 with reference to the rib (not shown), or with others items of luggage. Further, by utilizing the notch remnant 46, from the wall 22, material costs are reduced.

Although a particular embodiment of the invention has been described in detail for purposes of illustration, various modifications may be made without departing from the spirit and scope of the invention. Accordingly, the invention is not to be limited, except as by the appended claims.

I claim:

1. A method of constructing a contoured corner for a flexible luggage wall, comprising:

providing a rigid, generally rectangular luggage body having rounded corners;

providing a rectangular, flexible wall having a primary plane and overall dimensions generally matching the periphery of the luggage body;

cutting a curved notch from a corner of the rectangular wall to obtain a notch remnant;

folding a portion of the wall adjacent the notch downwardly to form a wall notch flange;

folding downwardly the periphery of the notch remnant to form a notch remnant flange;

placing a flexible piping along the curved notch and replacing the notch remnant adjacent the piping and sewing the wall notch flange, the piping and the notch remnant flange together in a manner causing the notch remnant to form a three-dimensional, arch-shape; and sewing the wall and the attached notch remnant to the luggage body.

2. A method as set forth in claim 1, wherein the flexible wall is constructed to include a pressed polyethylene interior having a laminated, air and water resistant exterior, and wherein the flexible piping is constructed of a PVC material and includes a relatively flat flange portion sewn between the wall notch flange and the notch remnant flange, and a relatively cylindrical or rounded portion which is allowed to extend exteriorly.

3. A method as set forth in claim 1, wherein the wall and the notch remnant are sewn to the luggage body in a manner forming a transition curvature between the primary plane of the wall and the adjacent portions of the luggage body.

4. A method as set forth in claim 1, including the step of sewing flexible piping between the luggage body and the flexible wall including the attached notch remnant.

5. A method as set forth in claim 4, wherein the flexible wall is constructed to include a pressed polyethylene interior having a laminated, tear and water resistant exterior, wherein the flexible piping is constructed of a PVC material and includes a relatively flat flange portion sewn between the wall notch flange and the notch remnant flange, and a relatively cylindrical or rounded portion allowed to extend exteriorly, and wherein the manner in which the notch remnant flange, the piping and the wall notch flange are sewn together and then sewn into the luggage body gives the portions of the wall adjacent the luggage body a transition curvature between the primary plane of the wall and the planes of adjacent portions of the luggage body.

6. A method of attaching a generally rectangular, flexible wall having a primary plane, to a relatively rigid, generally rectangular luggage body to form a flexible contoured corner having a three-dimensional arch-shape, the steps comprising:

cutting a curved notch from a corner of the rectangular wall;

providing a segment of relatively flexible and resilient material dimensioned to be sewn into the curved notch;

placing a flexible piping along the curved notch and placing the segment of relatively flexible and resilient material adjacent the piping;

sewing the segment of relatively flexible and resilient material and the flexible piping into the curved notch in a manner causing the segment of relatively flexible and resilient material to form a three-dimensional arch-shape; and sewing the flexible wall and the attached segment of relatively flexible and resilient material to the luggage body.

7. A method as set forth in claim 6, including the step of folding a portion of the flexible wall adjacent the curved notch downwardly to form a wall notch flange.

8. A method as set forth in claim 7, including the step of folding downwardly the periphery of the segment of relatively flexible and resilient material to form a notch remnant flange, whereby the notch remnant flange can be sewn to the wall notch flange to connect the segment of relatively flexible and resilient material to the flexible wall.

9. A method as set forth in claim 6, wherein the segment of relatively flexible and resilient material is the material cut from the corner of the rectangular wall to form the curved notch.

10. A method as set forth in claim 9, wherein the material cut from the corner of the rectangular wall to form the curved notch is trimmed to have a generally circular shape.

11. A method as set forth in claim 6, wherein the flexible wall and the segment of relatively flexible and resilient material are sewn to the luggage body in a manner forming a transition curvature between the primary plane of the wall and the adjacent portions of the luggage body.

12. A method as set forth in claim 6, including the step of sewing a second flexible piping between the luggage body and the segment of relatively flexible and resilient material.

13. A method as set forth in claim 12, wherein the second flexible piping is constructed of a PVC material and includes a relatively flat flange portion and a relatively cylindrical or rounded portion which is allowed to extend exteriorly.

14. A method as set forth in claim 6, wherein the flexible wall is constructed to include a pressed polyethylene interior having a laminated, water resistant exterior.

15. A method of attaching a relatively flexible luggage wall of bounce-back material to a relatively rigid, generally rectangular luggage body to form a flexible contoured corner having a three-dimensional arch-shape, the steps comprising:

cutting a curved notch from a corner of the rectangular wall and removing a notch remnant from the wall;

folding a portion of the wall adjacent the notch downwardly to form a wall notch flange;

trimming the notch remnant to have a generally circular shape;

folding downwardly the periphery of the notch remnant to form a notch remnant flange;

placing a first flexible piping along the curved notch and replacing the notch remnant adjacent the first flexible piping and sewing the wall notch flange, the first flexible piping and the notch remnant flange together in a manner causing the notch remnant to form a three-dimensional arch-shape; and placing a second flexible piping between the luggage body and the flexible wall including the notch remnant, and sewing the flexible wall and the notch remnant to the luggage body in a manner securing the second flexible piping therebetween.

16. A method as set forth in claim 15, wherein the first and second flexible pipings are constructed of a PVC material and include a relatively flat flange portion extending interiorly, and a relatively cylindrical or rounded portion which is allowed to extend exteriorly.

17. A method of attaching a generally rectangular, flexible wall to a relatively rigid, generally rectangular luggage body to form a resilient and flexible contoured corner having a three-dimensional arch-shape, the steps comprising:

cutting a curved notch from a corner of the rectangular wall;

folding a portion of the wall adjacent the notch downwardly to form a first wall notch flange;

providing a segment of relatively flexible and resilient bounce-back material dimensioned to be sewn into the curved notch;

folding downwardly the periphery of the flexible and resilient bounce-back material to form a second flange;

sewing the segment of relatively flexible and resilient bounce-back material into the curved notch such that the first wall notch flange and the second flange cause the segment of relatively flexible and resilient material to form a flexible three-dimensional arch-shape;

sewing the flexible wall and the attached segment of relatively flexible and resilient bounce-back material to the luggage body; and sewing a flexible piping between the luggage body and the flexible wall including the attached segment of bounce-back material.

* * * * *